US007938765B2

(12) United States Patent
Hayasaka

(10) Patent No.: US 7,938,765 B2
(45) Date of Patent: May 10, 2011

(54) CENTRIFUGE HAVING A LOCK MECHANISM

(75) Inventor: Hiroshi Hayasaka, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 401 days.

(21) Appl. No.: 12/136,170

(22) Filed: Jun. 10, 2008

(65) Prior Publication Data

US 2008/0305938 A1 Dec. 11, 2008

(30) Foreign Application Priority Data

Jun. 11, 2007 (JP) ..... P2007-153515

(51) Int. Cl.
*B04B 7/06* (2006.01)

(52) U.S. Cl. ..... 494/12; 70/278.7; 70/432; 292/201

(58) Field of Classification Search ..... 494/1, 7–12, 494/16–21, 31, 33, 84; 210/85, 144, 363; 70/84, 277, 278.7, 432, 256, 257, 280–283, 70/158–162; 292/201, 194, 202, 203, 44, 292/49, 196, 97, 116, 117, 213, 208, 39, 292/51, 112, 160, 142, 144
See application file for complete search history.

(56) References Cited

U.S. PATENT DOCUMENTS 2,399,812 A * 5/1946 Ledin ..... 70/84
3,633,041 A * 1/1972 Koskela ..... 307/119
3,866,825 A * 2/1975 Balazer et al. ..... 494/12
4,345,713 A * 8/1982 Gutierrez et al. ..... 494/12
5,280,975 A * 1/1994 Tscheu et al. ..... 292/251
6,056,684 A * 5/2000 Linder et al. ..... 494/12
6,241,650 B1 * 6/2001 Letourneur ..... 494/11
6,315,336 B1 * 11/2001 Swartzell ..... 292/201
6,334,841 B1 * 1/2002 Letourneur ..... 494/11
7,029,040 B2 * 4/2006 Lippoldt et al. ..... 292/201
(Continued)

FOREIGN PATENT DOCUMENTS

DE 2816395 A1 * 10/1979
(Continued)

OTHER PUBLICATIONS

Japanese Notification of Reason for Refusal, with English Translation, issued in Japanese Patent Application No. 2007-153515, dated Oct. 19, 2010.

*Primary Examiner* — Charles E Cooley
(74) *Attorney, Agent, or Firm* — McDermott Will & Emery LLP

(57) ABSTRACT

According to an aspect of the present invention, there is provided a centrifuge including: a rotor rotated by a driver; a chamber housing the rotor therein; a cover openable and closable with respect to the chamber; and a lock mechanism that locks the cover in a closed state, wherein the lock mechanism includes: a motor; a first hook rotated by the motor; and a second hook connected to the first hook through a connecting member, wherein the cover includes a securing portion on which the first hook and the second hook are respectively secured when the cover is locked, and wherein, during a locking operation of the cover, primary the first hook is engaged with the securing portion and pulls the cover toward the chamber, and then the second hook is engaged with the securing portion.

6 Claims, 6 Drawing Sheets

U.S. PATENT DOCUMENTS

| | | | | |
|---|---|---|---|---|
| 7,278,961 | B2 * | 10/2007 | Takahashi et al. | 494/12 |
| 7,288,060 | B2 * | 10/2007 | Takahashi | 494/12 |
| 7,311,653 | B2 * | 12/2007 | Kusumoto | 494/16 |
| 7,334,823 | B2 * | 2/2008 | Courter et al. | 292/201 |
| 7,500,942 | B2 * | 3/2009 | Takahashi et al. | 494/12 |
| 2001/0024039 | A1 * | 9/2001 | Lippoldt et al. | 292/197 |
| 2005/0173932 | A1 * | 8/2005 | Lomicka et al. | 292/201 |
| 2006/0058168 | A1 * | 3/2006 | Kusumoto | 494/16 |
| 2006/0166801 | A1 * | 7/2006 | Takahashi | 494/12 |
| 2006/0178253 | A1 * | 8/2006 | Takahashi et al. | 494/12 |
| 2008/0132395 | A1 * | 6/2008 | Takahashi et al. | 494/7 |
| 2008/0220958 | A1 * | 9/2008 | Hayasaka et al. | 494/7 |
| 2008/0305938 | A1 * | 12/2008 | Hayasaka | 494/12 |
| 2009/0139286 | A1 * | 6/2009 | Kishimoto | 70/277 |
| 2009/0212580 | A1 * | 8/2009 | Ballhause | |
| 2010/0090066 | A1 * | 4/2010 | Holemans | 244/171.3 |

FOREIGN PATENT DOCUMENTS

| | | |
|---|---|---|
| JP | 48-684000 | 9/1973 |
| JP | 2001-300350 | 10/2001 |
| JP | 2002-035643 | 2/2002 |
| JP | 2003-348492 | 12/2003 |
| JP | 2008-194595 | 8/2008 |

* cited by examiner

CENTRIFUGE HAVING A LOCK MECHANISM

CROSS-REFERENCE TO RELATED APPLICATIONS

This application is based upon and claims a priority from prior Japanese Patent Application No. 2007-153515 filed on Jun. 11, 2007, the entire contents of which are incorporated herein by reference.

BACKGROUND OF THE INVENTION

1. Field of the Invention

An aspect of the present invention relates to a centrifuge which includes a single motor as a drive source and a lock mechanism for locking a cover in the two portions thereof.

2. Description of the Related Art

A centrifuge is a machine in which a rotor with a sample stored therein is driven and rotated in a rotor rotation chamber to thereby centrifuge the sample. In the centrifuge, the opening of the rotor ration chamber can be opened and closed with a cover; during the centrifuging operation of the centrifuge while the rotor is rotating, the opening of the rotor rotation chamber is closed by the cover; and, before and after the centrifuging operation, in order to charge and discharge the sample, the cover is opened.

Generally, in a centrifuge which is used in a laboratory or the like, in order to prevent the rotating rotor from being exposed, the cover, which has closed the opening of the rotor rotation chamber, is locked automatically. As a method for locking the cover, there are known two types of methods: that is, in one type, the cover is simply caught by a latch; and, in the other type, the closed state of the cover is detected and, based on this detection, a lock mechanism is operated automatically, whereby the cover cannot be opened manually.

As a drive method for driving the lock mechanism, there are known two types of drive methods: that is, in one type, the cover is latched by reciprocating it using an electromagnetic solenoid; and, in the other type, the cover is pulled in using a motor (for example, see JP-2001-300350-A).

Recently, there has been increasing the need for consideration for safety in order that, even when the rotor is broken during rotation, the broken pieces thereof can be prevented from flying externally of the centrifuge. In this respect, a lock mechanism of a motor drive type, which can provide a relatively large sealing power, is advantageous. A lock mechanism plays an important role as a portion concerned with the safety of the centrifuge, and the reliability of the lock mechanism provides an important element.

Conventionally, several kinds of lock mechanisms using a motor are put into practical use and, in many cases, depending on the intensity of the energy of the rotor and the complexity of the breaking mode of the rotor, the cover is locked in a plurality of positions thereof. In a structure where independent motors are disposed in the individual lock mechanisms according to the relationship between the lock positions of the cover, the cost of the structure is large.

In view of this, there is also proposed a lock mechanism which includes a drive side hook to be driven and rotated by a single motor and a driven side hook connected by a connecting member to the drive side hook to be rotated integrally with the drive side hook, wherein the drive side hook and driven side hook are engaged with the securing members of the cover to thereby lock the cover at two positions thereof.

In the above lock mechanism, when there is employed a structure where both of the drive side hook and driven side hook are engaged with the securing member of the cover and securing member is pulled in to thereby bring the cover into close contact with the opening of the rotor rotation chamber, the two hooks must have a large force to pull in the securing member. In this case, a drive force from the motor is transmitted from the drive side hook through the connecting member to the driven side hook, so that a large torsion torque is applied to the connecting member. Owing to this, high strength and rigidity are required of the connecting member, resulting in the increased dimension (thickness) and weight of the connecting member.

SUMMARY OF THE INVENTION

The present invention aims to solve the above problem and to provide a centrifuge which, when closing a cover, pulls in the securing member of a cover only by a drive side hook to reduce the transmission torque of a connecting member to thereby be able to reduce the size and weight of the connecting member, and also which, after the securing member is pulled in, positively locks the two portions of the cover by both the drive side hook and driven side hook to thereby be able to secure high level of safety.

According to an aspect of the present invention, there is provided a centrifuge including: a rotor that holds a sample therein; a drive device that drives the rotor to rotate; a chamber that houses the rotor therein; a cover that is opened and closed with respect to the chamber; and a lock mechanism that locks the cover in a closed state, wherein the lock mechanism includes: a motor; a first hook that is rotated by the motor; and a second hook that is connected to the first hook through a connecting member and is rotated according to a rotation of the first hook, wherein the cover includes a securing portion on which the first hook and the second hook are respectively secured when the cover is locked, and wherein, during a locking operation of the cover, primary the first hook is engaged with the securing portion to pull the cover toward the chamber, and the second hook is engaged with the securing portion when the cover have been pulled.

The first hook may include an engagement surface that is engaged with the securing portion during the locking operation. The engagement surface may include: a first portion that is formed in an arc shape; and a second portion that is continuously formed with the first portion and is formed in a linear shape. A distance between a rotating center of the first hook and a point on the engagement surface where the engagement surface firstly contacts the securing portion during the locking operation may be set to L2. A distance between the rotating center and a point on the engagement surface where the engagement surface contacts the securing portion when the cover is locked may be set to L1.

L2 may be set larger than L1. The engagement surface may be continuously formed so that a distance between the rotating center and the engagement surface gradually decreases from L2 to L1.

BRIEF DESCRIPTION OF THE DRAWINGS

Embodiments of the present invention will be described in detail based on the following figures, wherein.

DETAILED DESCRIPTION OF THE INVENTION

Description will be given below of a centrifuge according to an embodiment of the invention.

Figure 1:
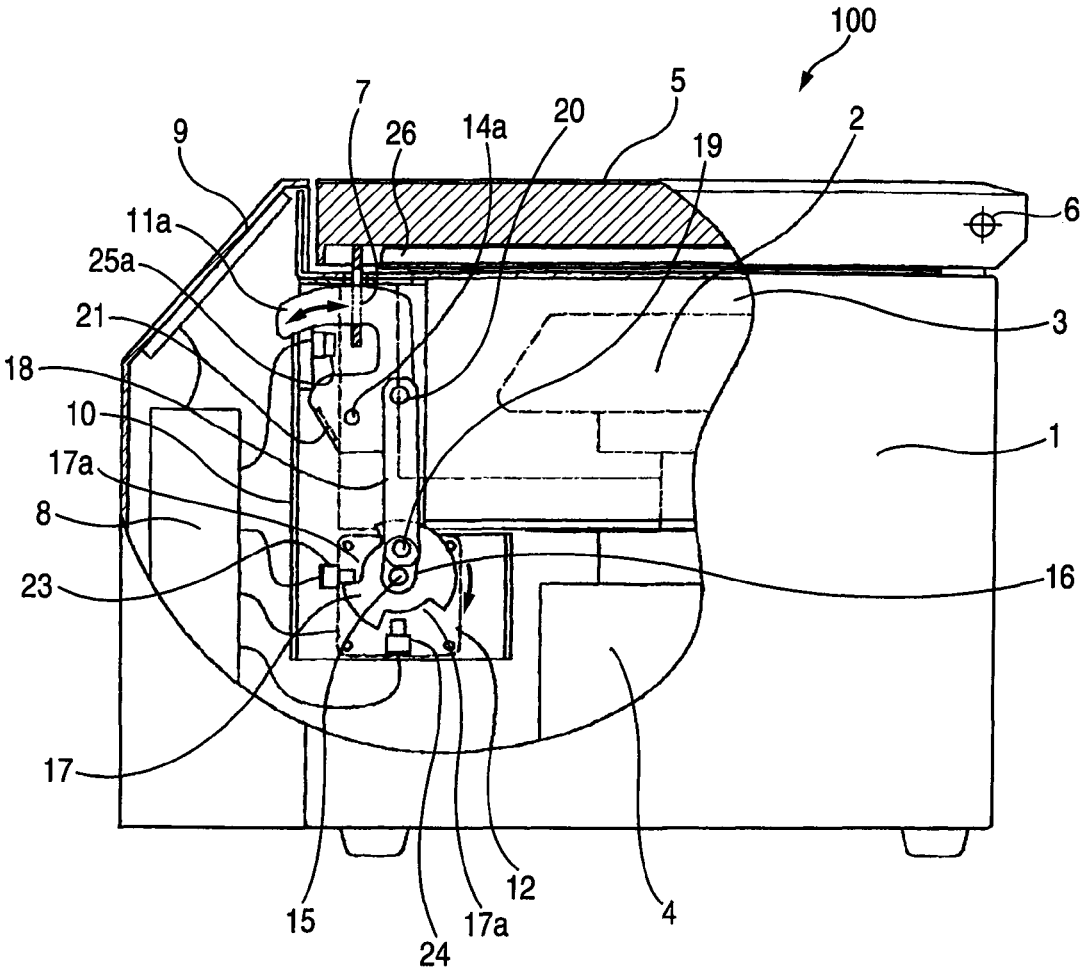
FIG. 1 is a broken side view of a centrifuge according to an embodiment.
Figure 2:
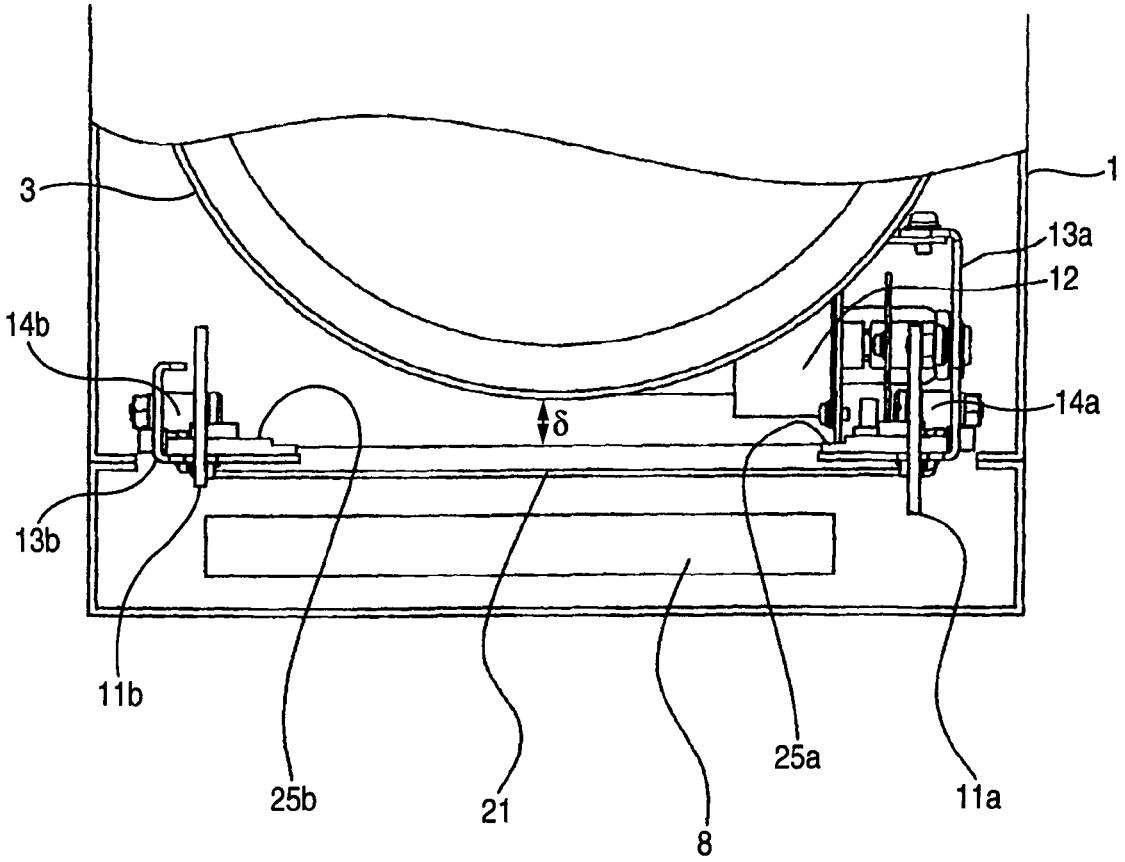
FIG. 2 is a broken plan view of the lock mechanism portion of the centrifuge according to the embodiment.
Figure 3:
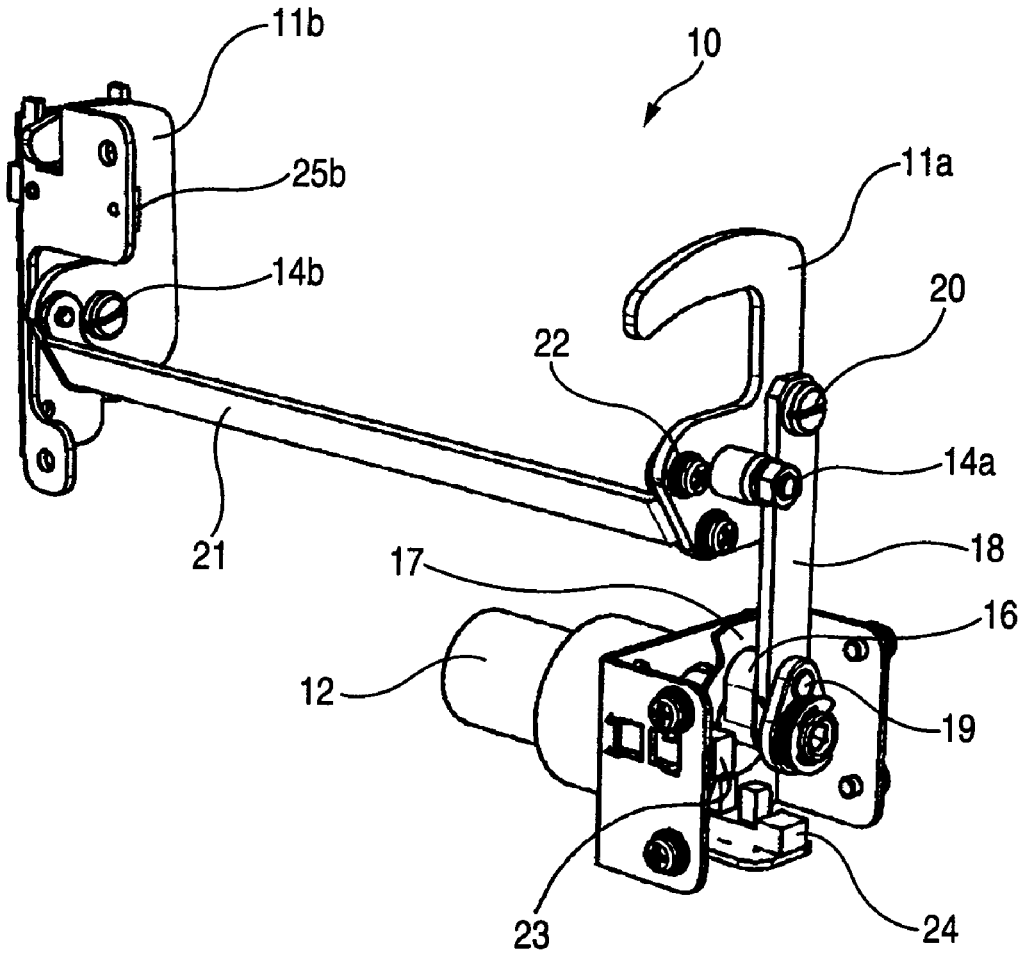
FIG. 3 is a perspective view of a lock mechanism provide in the centrifuge according to the embodiment.

FIG. 1 is a broken side view of a centrifuge according to the embodiment, FIG. 2 is a broken plan view of a lock mechanism portion included in the centrifuge, and FIG. 3 is a perspective view of a lock mechanism.

As shown in FIG. 1, in a main body 1 of a centrifuge, there is formed a rotor rotation chamber 3 for storing a rotor 2 therein and, downwardly of the rotor rotation chamber 3, there is disposed a drive device 4 which is used to drive and rotate the rotor 2. Upwardly of the rotor rotation chamber 3, there is disposed an openable/closable cover 5 which, when charging and discharging a sample to be centrifuged, is used to gain access to the rotor rotation chamber 3. One end of the cover 5 is rotatably supported by a hinge 6. The cover 5 is rotated with the hinge 6 as a center to open and close the upper surface opening of the rotor rotation chamber 3.

On the lower portion two sides (on the two sides in the vertical direction of the sheet surface of FIG. 1) that exist on the opening and closing side of the cover 5, there are vertically mounted a pair of hook catches 7 serving as a securing member for locking the cover 5. When the hook catches 7 are caught by a pair of hooks 11*a*, 11*b* of a lock mechanism 10 disposed in the main body 1, the opening/closing of the cover 5 can be locked.

As shown in FIG. 1, on the centrifuge main body 1, there are provided a control device 8 and an operation panel 9, while these two parts are electrically connected to each other.

Here, description will be given below of the structure of the lock mechanism 10.

As shown in FIG. 2, the pair of hooks 11*a* and 11*b* are respectively disposed at the positions that correspond to the pair of hook catches 7 on the outer peripheral side of the rotor rotation chamber 3, while the two hooks 11*a* and 11*b* are spaced from each other; and, the drive side hook 11*a* can be driven by a single motor 12 shown in FIG. 3. The pair of hooks 11*a* and 11*b*, as shown in FIG. 2, are rotatably supported on their associated frames 13*a* and 13*b* respectively mounted on the main body 1 by their associated shafts 14*a* and 14*b*.

As shown in FIG. 3, the motor 12 is provided horizontally on one drive side end and, to the output shaft (motor shaft) 15 of the motor 12, there are connected a link shaft 16 and a disk-shaped disk plate 17. And, to the end portion of the link shaft 16 that is set eccentric to the axis of the motor shaft 15, there is connected one end of a link 18 by a pin 19, while the other end of the link 18 is connected by a pin 20 to such position of the drive side hook 11*a* that is set eccentric to the shaft 14*a*. The drive side hook 11*a* and driven side hook 11*b* are connected to each other by a stay 21 serving as a connecting member. The two ends of the stay 21 are respectively mounted on the drive side hook 11*a* and driven side hook 11*b* at such positions thereof that are offset on the opposite side (in FIG. 3, on this side) to the rotor rotation chamber 3 with respect to the two hooks 11*a* and 11*b*.

As shown in FIG. 1, in the outer periphery of the disk plate 17, there are formed two notches 17*a*; and, on the periphery of the disk plate 17, there are disposed two photosensors 23 and 24 which are used to optically detect the rotation position of the disk plate 17, that is, the rotation position of the motor output shaft 15. The two photosensors 23 and 24, as shown in FIG. 1, are electrically connected to the control device 8.

As shown in FIG. 2, the shafts 14*a* and 14*b* of the drive side hook 11*a* and driven side hook 11*b* are respectively disposed coaxially with each other on a straight line which is substantially in contact with the outer periphery of the rotor rotation chamber 3. The stay 21 for connecting together the drive side hook 11*a* and driven side hook 11*b*, in order to avoid its interference with the outer periphery of the rotor rotation chamber 3, is mounted at such position that is offset on the opposite side (in FIG. 2, downwardly) to the rotor rotation chamber 3 with respect to the shafts (centers of rotation) of the hooks 11*a* and 11*b*. Owing to this structure, between the stay 21 and the outer peripheral surface of the rotor rotation chamber 3, there is secured at least a clearance 6 (shown in FIG. 2), which prevents the stay 21 from interfering with the outer periphery of the rotor rotation chamber 3 in an angle range where the stay 21 rotates together with the drive side hook 11*a*.

As shown in FIGS. 1 and 2, on the two portions of the main body 1 that correspond to the hook catches 7 mounted on the cover 5, there are provided two lid sensors 25*a* and 25*b* which are used to detect the hook catches 7 to thereby detect the opening and closing states of the cover 5, while the two lid sensors 25*a* and 25*b* are electrically connected to the control device 8 (see FIG. 1).

Next, description will be given below of the shapes and operations of the drive side hook 11*a* and driven side hook 11*b* with reference to FIGS. 4~6.

Figure 4:
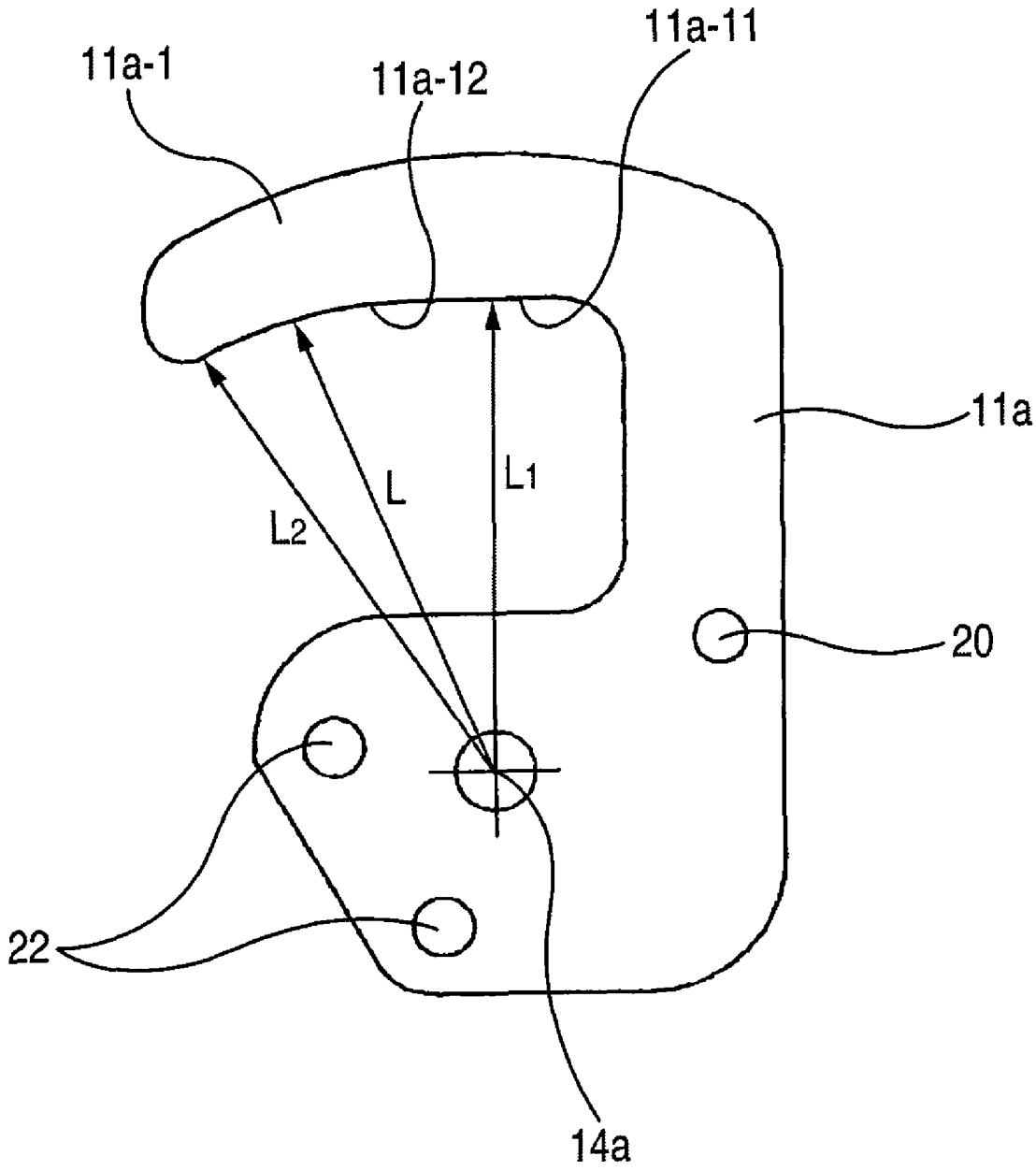
FIG. 4 is a side view of the drive side hook of the lock mechanism provided in the centrifuge according to the embodiment.
Figure 5:
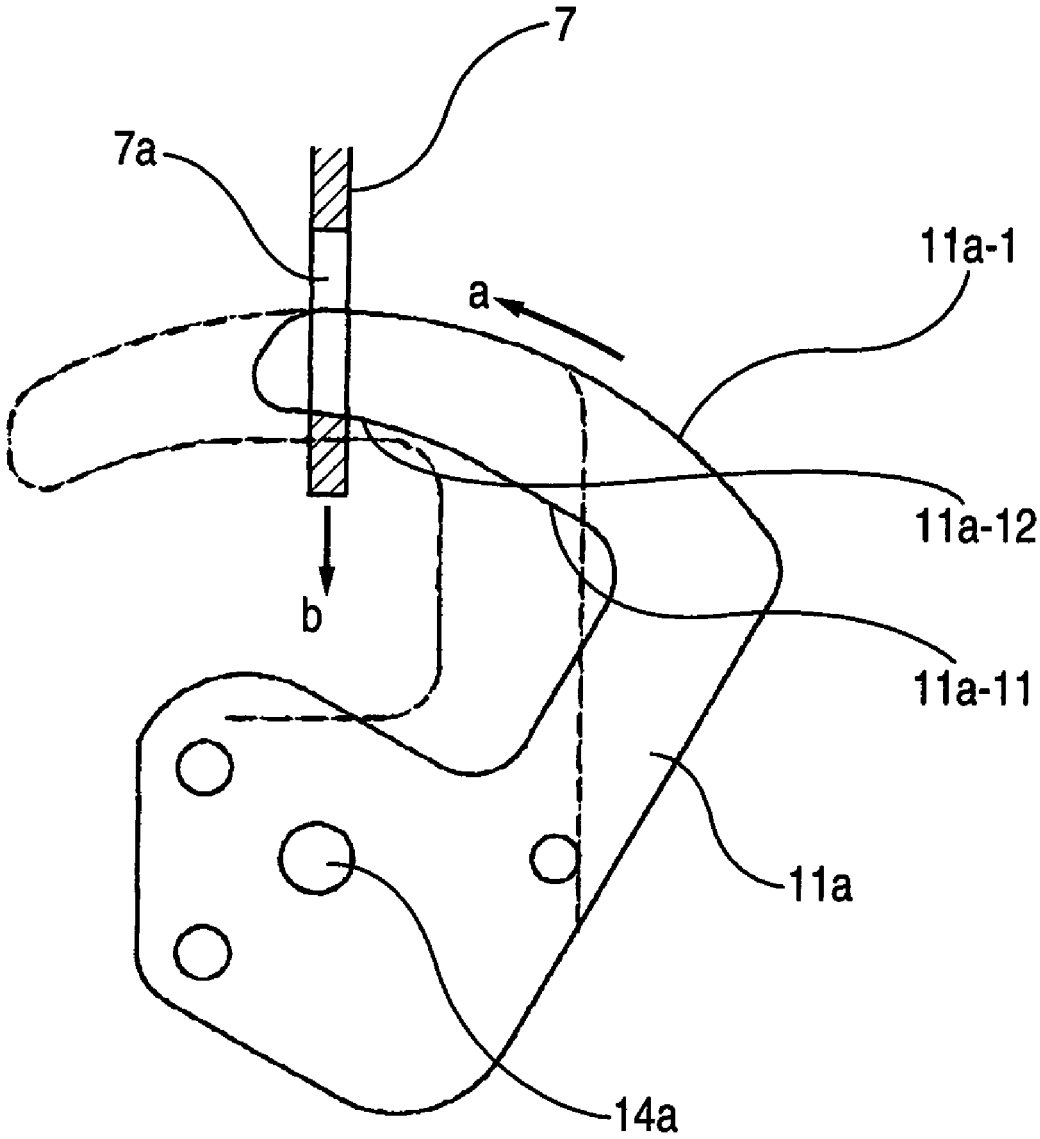
FIG. 5 is a side view of the drive side hook of the lock mechanism provided in the centrifuge according to the embodiment, explaining the operation of the drive side hook.
Figure 6:
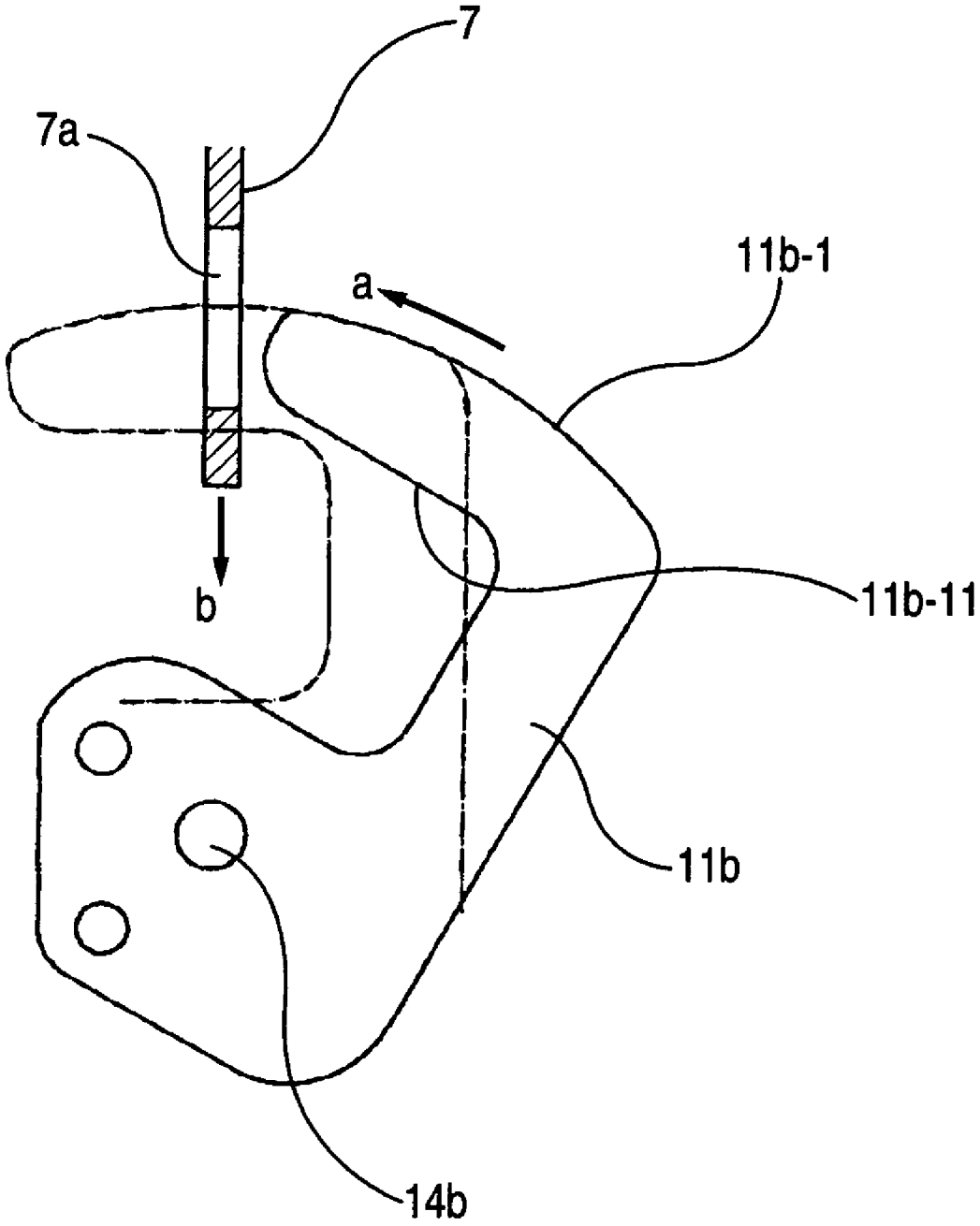
FIG. 6 is a side view of the driven side hook of the lock mechanism provided in the centrifuge according to the embodiment, explaining the operation of the driven side hook.

FIG. 4 is a side view of the shape of the drive side hook, FIG. 5 is a side view of the drive side hook, explaining the operation thereof, and FIG. 6 is a side view of the driven side hook, explaining the operation thereof.

As shown in FIG. 4, the drive side hook 11*a* includes an engaging pawl 11*a*-1. The engaging pawl 11*a*-includes a linear-shaped securing portion 11*a*-11 formed in the inside diameter portion thereof (in the contact portion thereof with the engaging hole 7*a* of the hook catch 7), and an arc-shaped guide portion 11*a*-12 formed in the portion thereof that exists forwardly of the inside diameter portion. The securing portion 11*a*-11 and guide portion 11*a*-12 are smoothly connected together. A distance from the shaft 14*a* (the center of rotation of the drive side hook 11*a*) to the securing portion 11*a*-11 and a distance L from the shaft 14*a* to the guide portion 11*a*-12 are respectively set for L1 and L2 which are respectively shown in FIG. 4.

A distance L2 from the shaft (center of rotation) 14*a* of the drive side hook 11*a* to the engagement start point of the guide portion 11*a*-12 is set larger than the distance L1 (a constant value) from the shaft (center of rotation) 14*a* to the securing portion 11*a*-11 (L2>L1). The distance L from the shaft (center of rotation) 14*a* of the drive side hook 11*a* to the guide portion 11*a*-12 gradually decreases toward the securing portion 11*a*-11 from the maximum value L2 to the minimum value L1. L1 expresses a distance when the cover 5 is locked, while L2 expresses a distance when the pulling-in operation of the hook catch 7 is started.

On the other hand, as shown in FIG. 6, on the driven side hook 11*b* as well, there is formed an engaging pawl 11*b*-1. However, in the inside diameter portion (the contact portion with the engaging hole 7*a* of the hook catch 7) of the engaging pawl 11*b*-1, there is formed only a linear-shaped securing portion 11*b*-11, but there is not formed a guide portion similar to the guide portion 11*a*-12 that is formed in the engaging pawl 11*a*-1 of the drive side hook 11*a*. Therefore, the length of the engaging pawl 11*b*-1 of the driven side hook 11*b* is smaller than that of the engaging pawl 11*a*-1 of the drive side hook 11*a*.

Thus, when, in order to close the cover 5 which is opened, the cover 5 is rotated downwardly about the hinge 6 and the upper surface opening of the rotor rotation chamber 3 is thereby closed by the cover 5, the pair of hook catches 7 mounted on the cover 5 are detected by the lid sensors 25*a* and 25*b*, and the detect signal is transmitted to the control device 8. On receiving this signal, the control device 8 drives and controls the motor 12, whereby the lock mechanism 10 is allowed to start the locking operation of the cover 5.

That is, in the lock mechanism 10, when the motor 12 is driven and the motor shaft 15 is driven and rotated, the link shaft 16 and disk plate 17 connected to the motor shaft 15 are integrally rotated; and, the rotation of the motor shaft 15 is transmitted through the link shaft 16 and link 18 to the drive side hook 11*a*, thereby rotating the drive side hook 11*a* in the same direction (in FIG. 5, in the arrow a direction). Since the rotation of the drive side hook 11*a* is transmitted through the stay 21 to the driven side hook 11*b*, the driven side hook 11*b* is also rotated in the same direction (in FIG. 6, in the arrow a direction).

As a result of this, the engaging pawl 11*a*-1 of the drive side hook 11*a* is engaged with the engaging hole 7*a* of the hook catch 7 and, as shown by a solid line in FIG. 5, firstly, the guide portion 11*a*-12 of the engaging pawl 11*a*-1 starts to be engaged with the engaging hole 7*a* of the hook catch 7. At the then time, the engaging pawl 11*b*-1 of the driven side hook 11*b*, as shown by a solid line in FIG. 6, is not yet engaged with the engaging hole 7*a* of the hook catch 7.

When the drive side hook 11*a* is rotated further from the above state, as described above, since the distance L from the shaft 14*a* to the guide portion 11*a*-11 of the engaging pawl 11*a*-1 decreases gradually from the maximum L2 to the minimum value L1, the hook catch 7 having the engaging hole 7*a* to be engaged with the guide portion 11*a*-11 is pulled in downwardly (in FIG. 5, in the arrow b direction) by the engaging pawl 11*a*-1; and, at the time when the engagement of the engaging pawl 11*a*-1 with the engaging hole 7*a* of the hook catch 7 reaches the securing portion 11*a*-12 from the guide portion 11*a*-11, the downward pulling-in operation of the hook catch 7 is ended and, at the then time, the pulling-in amount of the hook catch 7 provides (L2-L1).

Owing to the downward pulling-in operation of the catch hook 7, the cover 5 is closely contacted with the peripheral edge of the upper surface opening of the rotor rotation chamber 3. However, since, on the cover 5, there is also mounted another catch 7 disposed on the driven side, the driven side hook catch 7 is also pulled in downwardly (in FIG. 6, in the arrow b direction) similarly.

When the drive side hook 11*a* and driven side hook 11*b* are rotated further and, as shown by broken lines in FIGS. 5 and 6, the engaging pawls 11*a*-1 and 11*b*-1 of the two hooks 11*a* and 11*b* are completely inserted into the engaging holes 7*a* of the hook catches 7, and the securing portions 11*a*-1 and 11*b*-1 of the engaging pawls 11*a*-1 and 11*b*-1 are secured to the engaging holes 7*a* of the hook catches 7, the locking of the cover 5 is completed and, at the same time, the cover 5 is closely contacted with a door packing 26 which is provided on the peripheral edge of the upper surface opening of the rotor rotation chamber 3.

The rotation position of the motor shaft 15 can be detected by optically detecting the position of the disk plate 17 by the photosensors 23 and 24, and the detect signal is input to the control device 8. On receiving the detect signal, the control device 8 determines the position of the drive side hook 11*a* based on the rotation position of the motor shaft 15 and drives and rotates the motor 12. The locked state of the cover 5 by the lock mechanism 10 can be released through an operation to be carried out on the operation panel 7.

As described above, in the centrifuge 100 according to the embodiment, the guide portion 11*a*-12 of the engaging pawl 11*a*-1 of the drive side hook 11*a* to be driven directly by the motor 12 is engaged with the engaging hole 7*a* of the hook catch 7, and the hook catch 7 is pulled in downwardly to thereby bring the cover 5 into close contact with the door packing 26 provided on the upper surface opening peripheral edge of the rotor rotation chamber 3, while the pulling-in operation of the hook catch 7 is carried out only by one hook, that is, by the drive side hook 11*a* but is not carried out by the other hook, that is, by the driven side hook 11*b*. This eliminates the need to transmit a large drive force for pulling in the hook catch 7 to the driven side hook 11*b* through the stay 21, thereby being able to reduce the torsion torque that is applied to the stay 21. Thus, there is eliminated the need for the stay 21 to have high strength and rigidity, which can reduce the size and weight of the stay 21.

After the hook catch 7 is pulled in using the drive side hook 11*a* and the cover 5 is thereby closely contacted with the door packing 26 provided on the upper surface opening of the rotor rotation chamber 3, the engaging pawl 11*b*-11 of the driven side hook 11*b* is also engaged with the engaging hole 7*a* of the hook catch 7 and the cover 5 is thereby locked by both of the drive side hook 11*a* and driven side hook 11*b*. Owing to this, the cover 5 can be locked positively at the two positions thereof, which makes it possible to secure an enhanced level of safety.

Further, according to the present embodiment, the stay 21 for connecting together the drive side hook 11*a* and driven side hook 11*b* of the lock mechanism 10 is mounted at a position offset on the opposite side (in FIG. 2, downwardly) to the rotor rotation chamber 3 with respect to the shafts (centers of rotation) 14*a* and 14*b* of the hooks 11*a* and 11*b* in order to avoid its interference with the outer periphery of the rotor rotation chamber 3. Therefore, even when the shafts 14*a* and 14*b* of the drive side hook 11*a* and driven side hook 11*b* are respectively disposed on a straight line which is substantially in contact with the outer periphery of the rotor rotation chamber 3, there is secured at least such a clearance δ as shown in FIG. 2 between the stay 21 and the outer peripheral surface of the rotor rotation chamber 3 and thus, in the angle range where the stay 21 rotates, there is no possibility that the stay 21 can interfere with the outer periphery of the rotor rotation chamber 3. Therefore, the drive side hook 11*a* and driven side hook 11*b* can be disposed in such a manner that they exist close to the rotor rotation chamber 3. This can reduce the installation space of the lock mechanism 10, thereby being able to reduce the size and weight of the centrifuge.

According to an aspect of the present invention, when closing the cover, the pulling-in operation of the securing member of the cover is carried out only by one hook, that is, by the drive side hook to be driven directly by the motor, not by the other hook, that is, by the driven side hook. This avoids the need to transmit a large torsion torque for pulling in the securing member to the driven side hook through the connecting member, thereby being able to reduce the torsion torque applied to the connecting member. Therefore, the connecting member need not have high strength and rigidity, which makes it possible to reduce the size and weight of the connecting member.

Also, after the securing member of the cover is pulled in by the drive side hook and the cover is closely contacted with the rotor rotation chamber, the driven side hook is also engaged with the securing member to thereby lock the cover by both of the drive side and driven side hooks. This can positively lock the cover at the two positions thereof to thereby be able to secure high level of safety.

What is claimed is:

1. A centrifuge comprising:

a rotor that holds a sample therein;

a drive device that drives the rotor to rotate;

a chamber that houses the rotor therein and is disposed in a main body;

a cover that is opened and closed with respect to the chamber; and a lock mechanism that locks the cover in a closed state, wherein the lock mechanism includes:

a motor;

a first hook mounted on the main body and driven to rotate by the motor;

a second hook spaced from the first hook and mounted on the main body;

a connecting member for connecting the first hook with the second hook so that the second hook is rotated according to a rotation of the first hook; and a pair of hook catchers mounted on the cover to engage with the first hook and the second hook respectively to lock the cover in the closed state, the first hook being provided with a curved portion which is different from a shape of the second hook so that the first hook is engaged with one of the catchers first and then the second hook is engaged with the other of the catchers.

2. The centrifuge according to claim 1, wherein the hook catchers are provided with holes to be engaged with the first hook and the second hook respectively, and wherein the first hook is engaged with the one of the holes to pull the cover toward the chamber so that the second hook can be engaged with the other hole.

3. The centrifuge according to claim 2, wherein the first hook includes a first portion and a second portion to be engaged with the one of the holes, the first portion being formed in an arc shape and a second portion being continuously formed with the first portion and formed in a linear shape, and wherein the second hook includes a third portion to be engaged with the other hole and being formed in a linear shape.

4. The centrifuge according to claim 3, wherein a distance between a rotating center of the first hook and a point on the first portion of the first hook is set to L2, and a distance between the rotating center and a point on the second portion of the first hook is set to L1, and wherein L2 is set larger than L1.

5. The centrifuge according to claim 4, wherein an engagement surface of the first hook is continuously formed so that a distance between the rotating center and the engagement surface gradually decreases from L2 to L1.

6. The centrifuge according to claim 1, wherein the first hook is engaged with a first catcher to pull the cover toward the chamber at first and then the second hook is engaged with a second catcher when the cover has been pulled.

* * * * *